US008851352B2

(12) United States Patent
Erhardt et al.

(10) Patent No.: US 8,851,352 B2
(45) Date of Patent: Oct. 7, 2014

(54) SETTING TOOL

(75) Inventors: Rolf Erhardt, Buchs (CH); Peter Stauss, Feldkirch (AT); Dierk Tille, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 234 days.

(21) Appl. No.: 11/655,327

(22) Filed: Jan. 19, 2007

(65) Prior Publication Data

US 2007/0170224 A1 Jul. 26, 2007

(30) Foreign Application Priority Data

Jan. 25, 2006 (DE) ..... 10 2006 000 025

(51) Int. Cl.
*B25C 1/18* (2006.01)
*B25C 1/00* (2006.01)

(52) U.S. Cl.
CPC ..... *B25C 1/008* (2013.01)
USPC ..... 227/142; 227/8; 227/10; 227/147

(58) Field of Classification Search
CPC ..... B25C 1/001; B25C 1/08; B25D 9/14; B25D 17/08
USPC ..... 227/4, 8, 142, 147
See application file for complete search history.

(56) References Cited

U.S. PATENT DOCUMENTS 4,533,077 A * 8/1985 Jochum ..... 227/156
4,930,673 A * 6/1990 Pfister ..... 227/10
5,261,587 A * 11/1993 Robinson ..... 227/8
5,263,626 A * 11/1993 Howard et al. ..... 227/8
5,450,911 A * 9/1995 Gustafsson ..... 173/13
5,564,614 A * 10/1996 Yang ..... 227/142
5,597,972 A * 1/1997 Wachter ..... 227/10
5,988,477 A * 11/1999 Deieso et al. ..... 227/130
6,012,622 A 1/2000 Weinger et al.
6,138,887 A * 10/2000 Nayrac et al. ..... 227/8
6,145,727 A * 11/2000 Mukoyama et al. ..... 227/130
6,209,770 B1 * 4/2001 Perra ..... 227/8
6,647,836 B1 * 11/2003 Habermehl ..... 81/434
6,655,568 B2 * 12/2003 Thieleke ..... 227/8
6,695,192 B1 * 2/2004 Kwok ..... 227/8
6,722,551 B2 * 4/2004 Weibel et al. ..... 227/10
6,763,992 B2 * 7/2004 Hirai ..... 227/142
6,851,595 B1 * 2/2005 Lee ..... 227/142
7,055,729 B2 * 6/2006 Taylor et al. ..... 227/142
7,299,961 B2 * 11/2007 Stavig et al. ..... 227/142
2004/0149800 A1 8/2004 Perra et al.
2006/0043145 A1 3/2006 Liao
2011/0073630 A1 * 3/2011 Kakuda et al. ..... 227/8
2011/0297728 A1 * 12/2011 Liang et al. ..... 227/142

* cited by examiner

*Primary Examiner* — Gloria R Weeks
(74) *Attorney, Agent, or Firm* — Abelman, Frayne & Schwab

(57) ABSTRACT

A setting tool for driving a fastening element in a constructional component includes a housing (11), a drive member (13) displaceable in a guide (12) located in the housing, a bolt guide (15) adjoining the drive member guide (12) in direction of the operational axis (A) and forming a dog point (16) for abutting the constructional component and a drive-in depth setting tool (20) for displacing the bolt guide (15) axially relative to the drive member guide (15) for setting a distance between a drive end (14) of the drive member (13) and the dog point (16) in the initial position of the drive member.

8 Claims, 6 Drawing Sheets

SETTING TOOL

BACKGROUND OF THE INVENTION

1. Field of the Invention

The present invention relates to a setting tool for driving a fastening element in a constructional component and including a housing, a guide located in the housing, a drive member displaceable in the guide and defining an operational axis, a bolt guide adjoining the drive member guide in direction of the operational axis, with the drive member having a drive end adjacent to the bolt guide for driving the fastening element located in the bolt guide, and a drive-in depth setting tool for setting a distance between the drive end of the drive member and a dog point for abutting the constructional component in an initial position of the drive member.

2. Description of the Prior Art

Setting tools of the type described above are driven with solid, gaseous or liquid fuels, compressed air, or by electrical energy.

With such setting tool, in which the drive member such as setting piston or a ram drives a fastening element in a constructional component, the drive member is accelerated in the direction of the fastening element. In the combustion-engined setting tools, the drive member is driven, e.g., by combustion gases. The pressure, which is applied to the drive member, accelerates the drive member in the direction of the fastening element. The drive member impacts the fastening element, driving it in the constructional component.

In setting tools, the drive-in depth of the fastening element in the workpiece or distance of the head of the fastening element from the surface of the workpiece after a drive-in process, depends, among others, from the material of the workpiece in which the fastening element is driven in, and from the length and thickness of the fastening element stem. Dependent on the use, it is necessary to be able to adjust the drive-in depth distance between the head of the fastening element and the surface of the workpiece. In the gas-driven bolt setting tools, e.g., this is often effected by changing the distance of a setting piston tip in the frontmost position of the piston relative to the workpiece or the constructional component. The change of this distance is effected, e.g., by changing the length of the press-on system. There is a requirement to be able to perform this adjustment as simply as possible.

U.S. Pat. No. 6,012,622 discloses a hand-held setting tool having a drive-in depth setting device. The device includes an actuation feeler that projects past a nose part of the setting tool in the setting direction. The actuation feeler is axially adjusted relative to the nose part with an incremental control member formed as a knurled wheel, whereby different drive-in depths or distances of a to-be-set fastening element are set.

The drawback of the above-described setting tool consists in that the drive-in depth setting device has too many parts and, on the other hand, the dismounting of the nose part or of the bolt guide is rather expensive.

Accordingly, the object of the present invention is to provide a setting tool of the type described above in which the drawbacks listed above are eliminated.

Another object of the present invention is to provide a setting tool of the type described above and which can be simply formed and an adjustment or setting of the drive-in depth in a most simple manner possible can be effected.

SUMMARY OF THE INVENTION

These and other objects of the present invention, which will become apparent hereinafter, are achieved by providing a setting tool of the type described above and in which the bolt guide forms the dog point for abutting the workpiece or the constructional component and is displaced axially relative to the drive member guide by the drive-in depth setting device.

The foregoing novel features of the present invention permit to eliminate an additional component of the drive-in depth setting device that has the dog point, and provide a reliably functioning drive-in depth setting for releasing the tool.

Advantageously, the drive-in depth setting device axially displaces the bolt guide between at least two positions, retaining the bolt guide in a respective position. This permits to eliminate additional constructional measures for axial retaining of the bolt guide.

Advantageously, the bolt guide has a release position axially remote from the drive member guide and which corresponds to a release switching position of the drive-in depth setting device and in which the bolt guide is not any more retained by the drive-in depth setting device. Thereby, the bolt guide is released from the tool in the release switching position of the drive-in depth setting device and can be removed from the setting tool without an additional handle. The bolt guide is, thus, easily replaceable which insures an easily access for rectification of any malfunction and use of another bolt guide.

Advantageously, the drive-in depth setting device has a manually operable actuation member that is located, in at least two switching positions of the drive-in depth setting device in which the device axially secures the bolt guide in the at least two positions of the bolt guide, respectively, in a window formed in the housing where the actuation member is accessible. In the release switching position of the drive-in depth setting device, the actuation member is covered by a housing section located adjacent to the window. These features insure an easy operation of the drive-in depth setting device and, on the other hand, prevent an accidental actuation of the actuation member when the bolt guide is dismounted.

According to a constructively simple embodiment, the drive-in depth setting device includes a control link and link block displaceable in the control link which operate between the actuation member and the bolt guide. Instead of using the control link and link block as control means, e.g., toggle lever means, a tooth rack-/tooth gear unit, a threaded sleeve with an axially displaceable threaded rod, two links slidable relative to each other, an eccentric setting wheel can be used.

Advantageously, the drive-in depth setting device has a control roller connected with the actuation member for joint rotation therewith. With the control roller, the link control can be formed in a space-saving manner, without increasing the constructional length of the setting tool. Advantageously, the control link is provided on the control roller and the link block is provided on the bolt guide. Alternatively, the link block can be provided on the control roller, and the control link on the bolt guide.

It is advantageous, when there is provided a locking mechanism for releasably retaining the drive-in depth setting device in the switching positions. This prevents an accidental displacement of the drive-in depth setting device into another switching position, e.g., by a return pulse.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
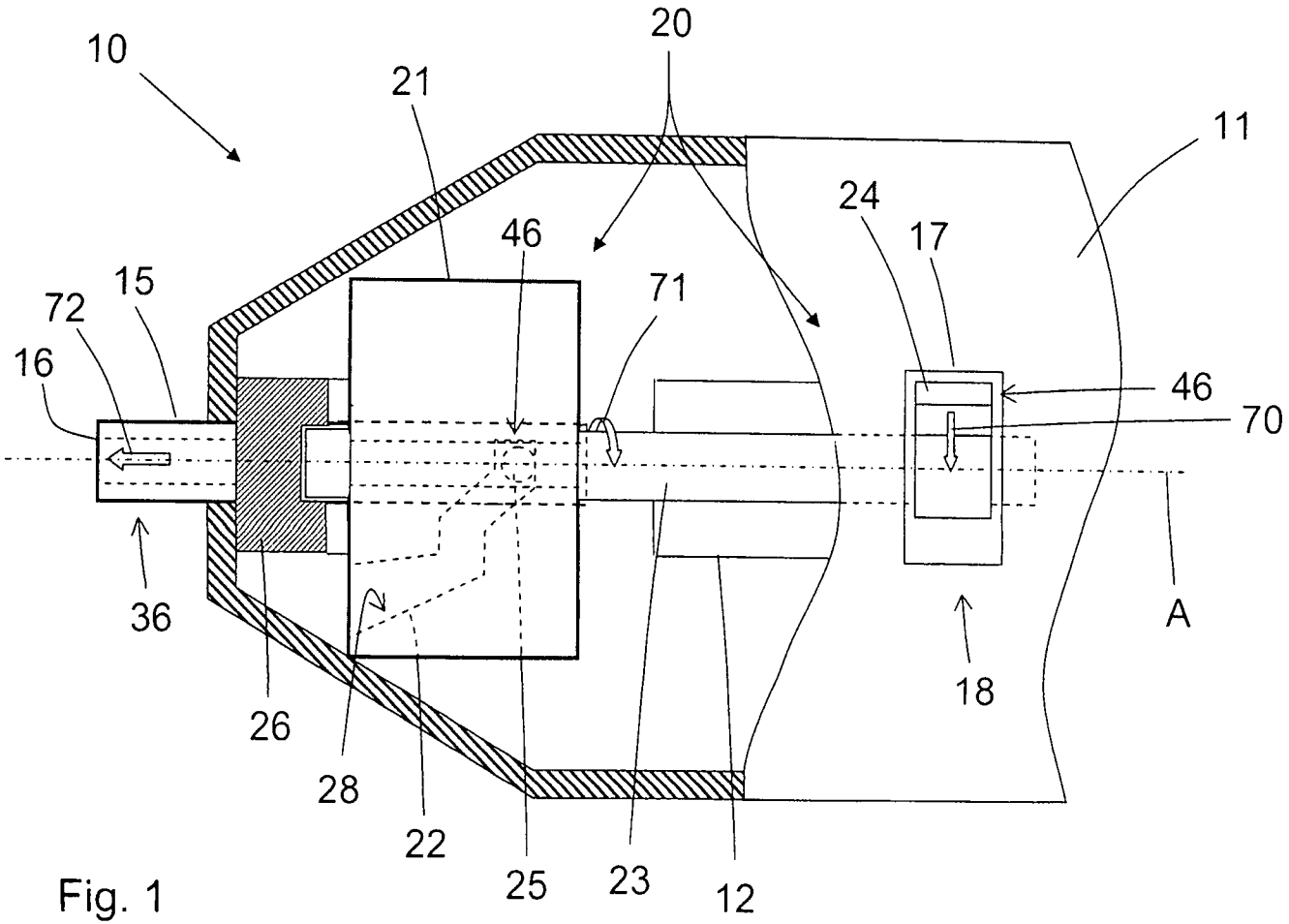
FIG. 1 a side, partially cross-sectional view of a mouth region of the setting tool according to the present invention with a drive-in depth adjusting device in a first position thereof.
Figure 2:
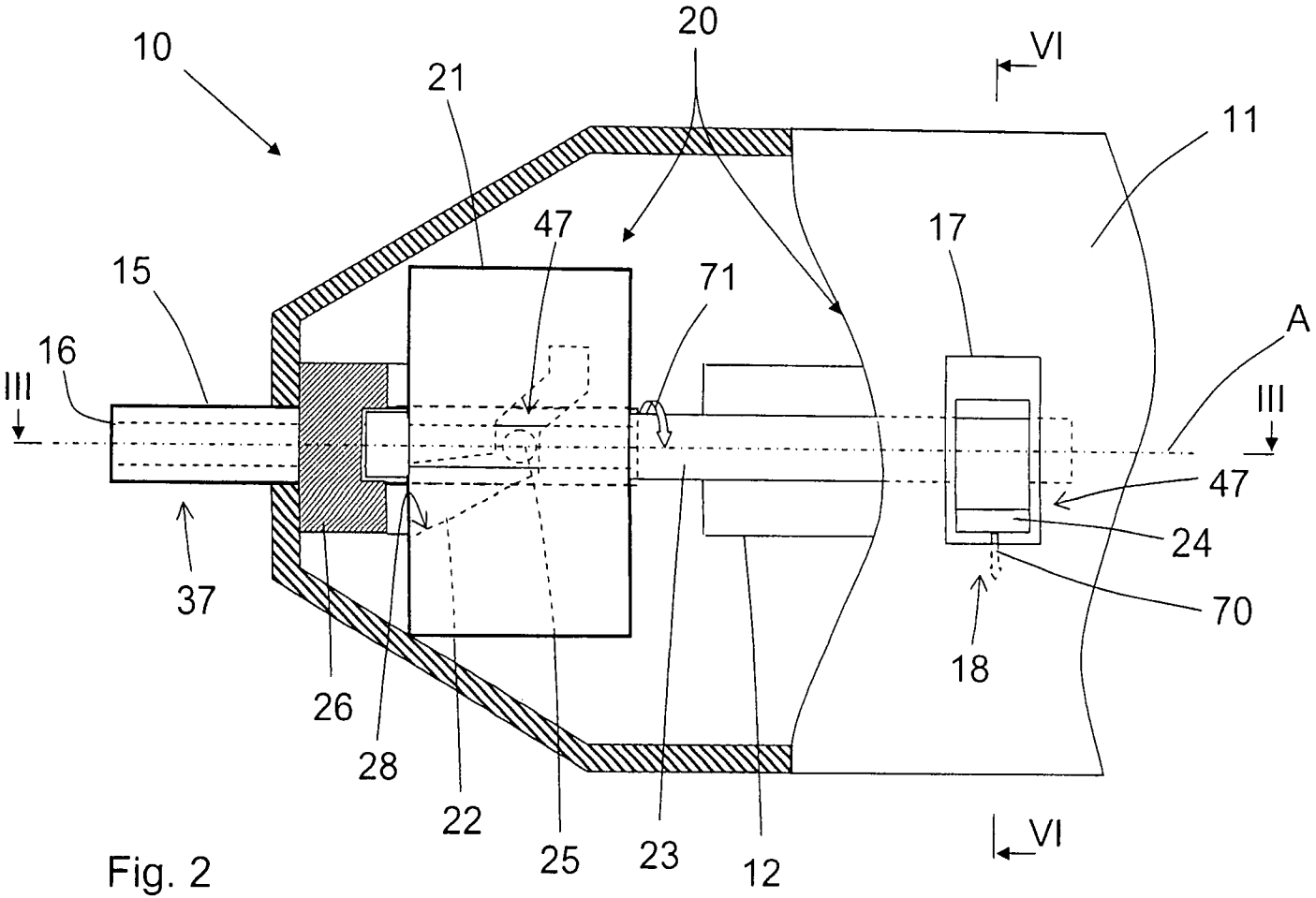
FIG. 2 a view similar to that of FIG. 1 with the drive-in depth adjusting device in a second position thereof.
Figure 3:
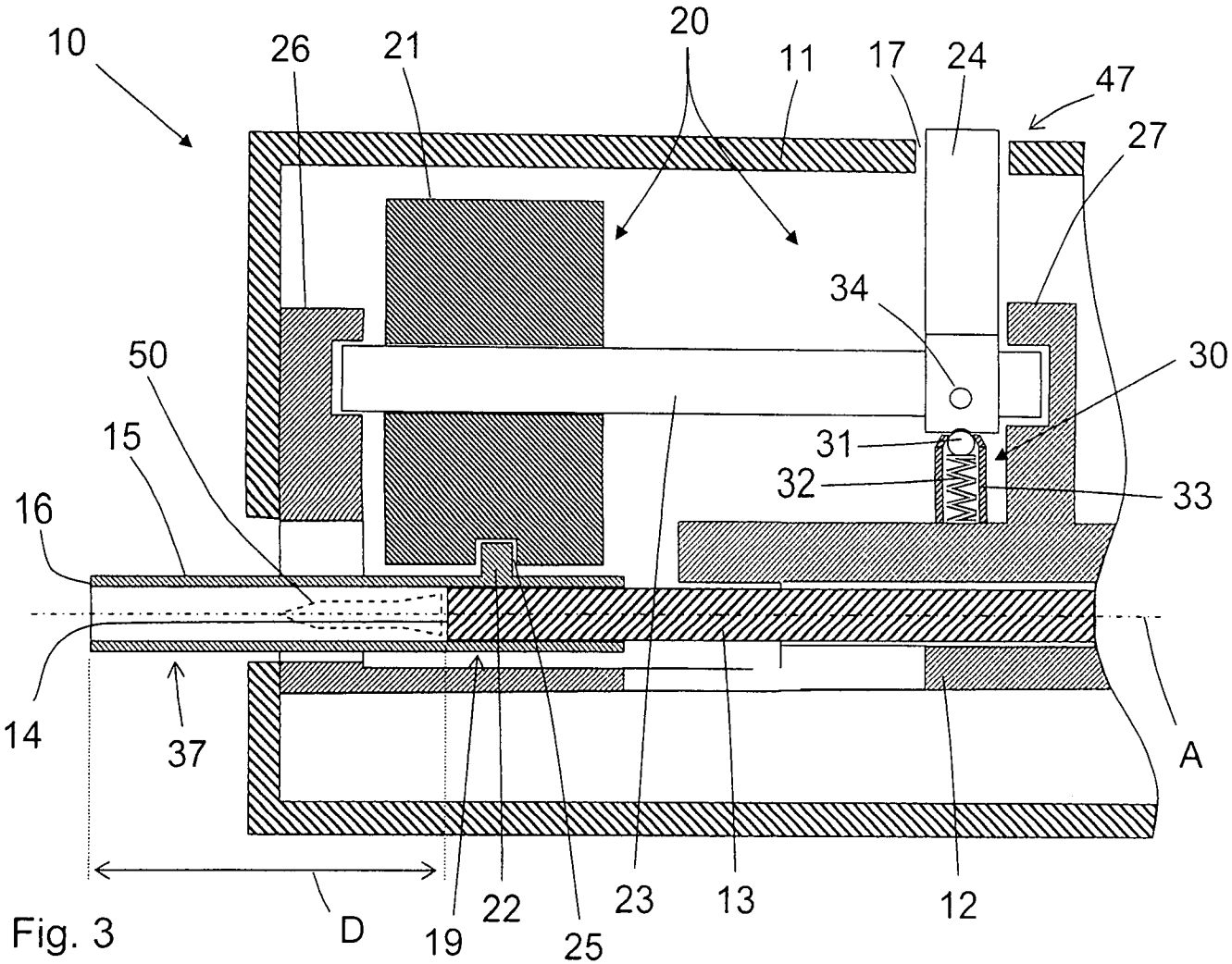
FIG. 3 a cross-sectional view of the mouth region of the inventive setting tool along line III-III in FIG. 2.
Figure 4:
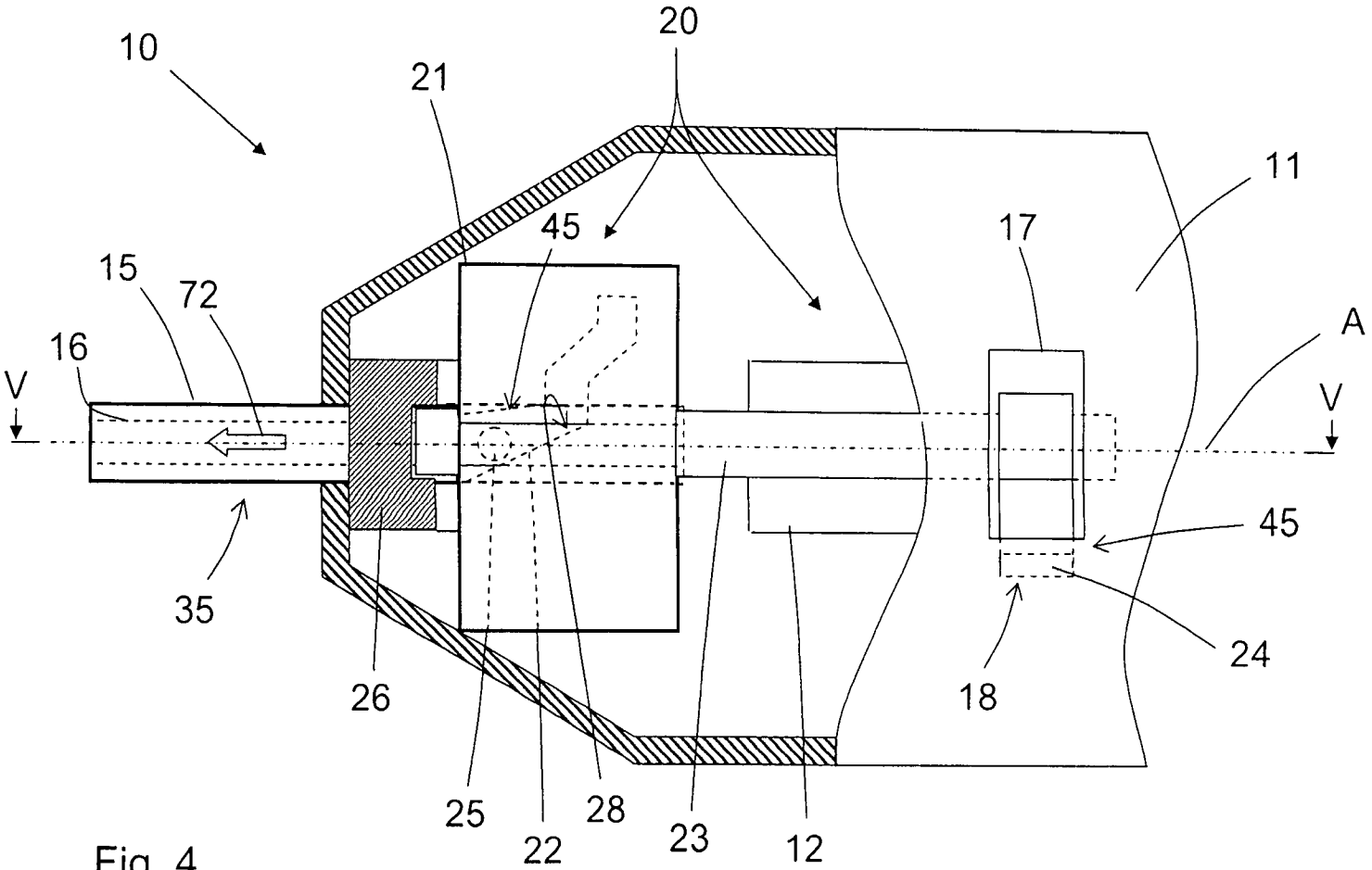
FIG. 4 a view similar to that of FIG. 1 with the drive-in depth adjusting device in a third position thereof.
Figure 5:
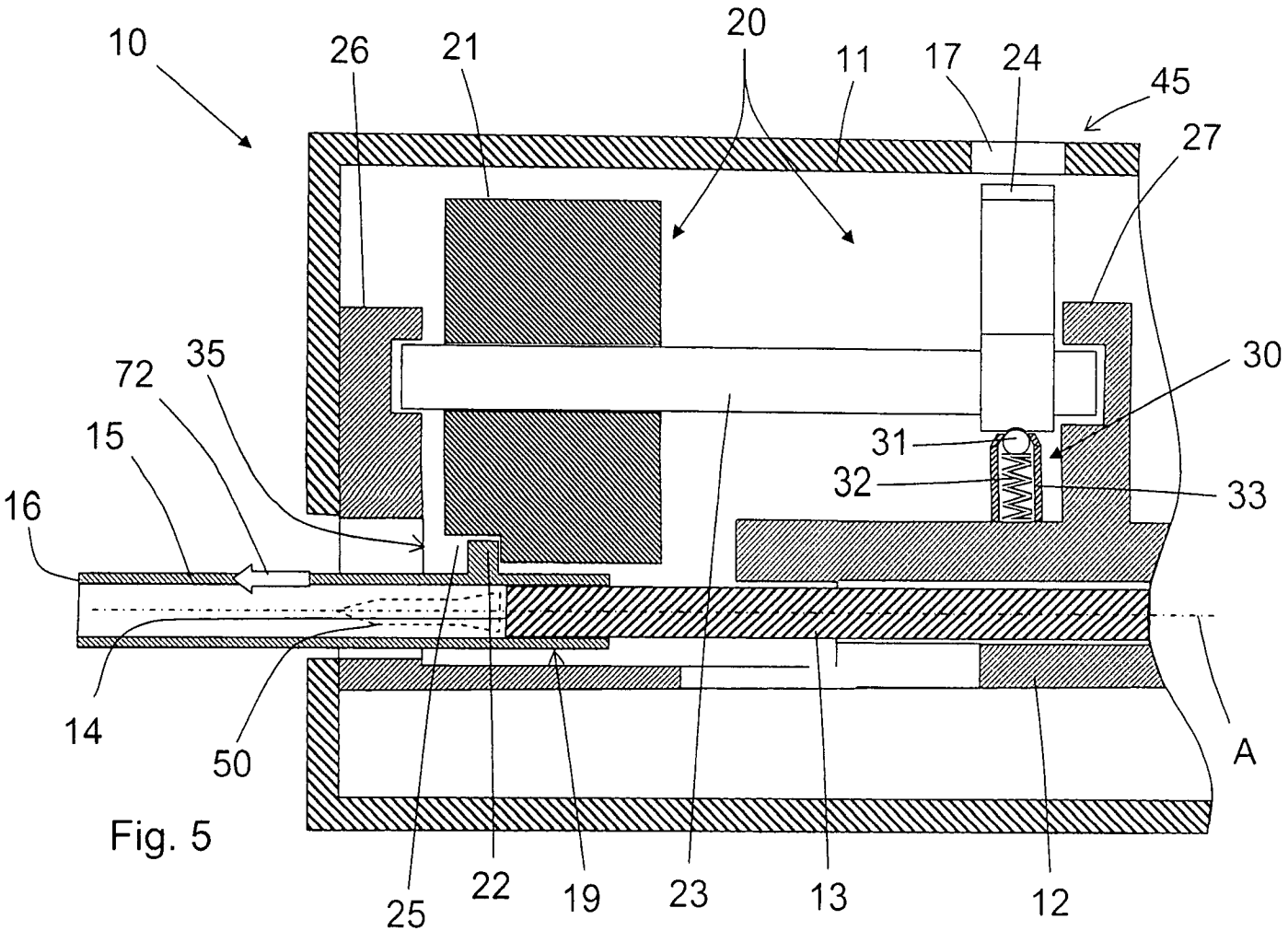
FIG. 5 a cross-sectional view of the mouth region of a setting tool along line V-V in FIG. 4.

FIGS. 1-6 show a mouth region of a hand-held setting tool 10 according to the present invention. The setting tool 10 can be formed, e.g., as a combustion power-driven tool and has a setting mechanism located in a tool housing 11. The setting mechanism includes a setting piston which is formed as a drive member 13 (see FIGS. 3 and 5). The drive member 13 is displaceable in a guide 12 and defines a longitudinal axis A of the setting tool. In FIGS. 3 and 5, the drive member 13 is shown in its initial position, ready for a setting process. In the setting tool 10, there is provided, coaxially with the guide 12, a bolt guide 15 having a dog point 16 that is located outside of the housing 11 for engaging a workpiece with the setting tool 10. The bolt guide 15 serves for receiving and guiding a fastening element 50 (schematically shown in FIG. 3). During a setting process, the fastening element 50, which is located in the bolt guide 15, is driven by a drive end 14 of the drive member 13 in the direction of the dog point 16 and into a workpiece (not shown). The drive-in depth of the fastening element 50 in a workpiece or the projection of the head of the fastening element 50 above the workpiece surface after completion of the drive-in process depends, among others, from the material of the workpiece into which the fastening element is driven in and from the length and width of the stem of the fastening element 50.

In order to be able to set different drive-in depths on the setting tool 10, the setting tool 10 is provided with a drive-in depth adjusting or setting device generally designated with a reference numeral 20. The drive-in depth setting device 20 includes a manually operated actuation member 24 supported on a support axle 23 for joint rotation therewith (see, in particular FIGS. 3, 5 and 6). The support axle 23 is rotatably or pivotally supported in the housing 11 by first and second bearings 26 and 27, respectively. On the support axle 23, there is further supported a control roller 21 for joint rotation with the axle 23.

On the control roller 21, there is provided first control means in form of a circumferential groove-shaped control link 22. On the bolt guide 15, there is provided second control means in form of a link block 25. The link block 25 is displaced in the control link 22 on the control roller 21, whereby the bolt guide 15 is secured axially on the setting tool 10 in switching positions 46, 47 of the drive-in depth setting device 20 shown in FIGS. 1-3 and 6 by the link block 25 displaceable in the control link 22, so that the bolt guide 15 cannot be removed from the setting tool 10. The actuation member 24 is located in the switching positions 46 and 47 (see FIGS. 1, 2, and 6) in the window 17 formed in the housing. In this way, the actuation member 24 is accessible for the user of the setting tool 10 and can be displaced manually from the first switching position 46 (see FIGS. 1 and 6) into the second switching position 47 (see FIGS. 2 and 6). By displacing the actuation member 24 from the first position 46 into the second position 47 (in the direction of arrow 70 in FIG. 1) and vice versa, the bolt guide 15 is displaced from a first position 36 (FIG. 1) in a second position 37 shown in FIG. 2 and vice versa. The displacement of the actuation member 24 causes rotation of the support axle 23, together with the control roller 31, and the bolt guide 15 is displaced as a result of engagement of the link block 25 in the control link 22 in the control roller 21. The displacement of the bolt guide 15 between the first position 36 and the second position 37 leads to an axial displacement of the bolt guide 15 relative to the guide 12 (in direction of arrow 12 in FIG. 1). Thereby, the distance D between the drive end 14 of the drive member 13 and a dog point 16 changes, whereby a drive-in depth also changes.

For dismounting of the bolt guide 15, the drive-in depth setting device 20 can be displaced with the actuation member 24 manually in a release switching position shown in FIGS. 4 and 5. To this end, the actuation member 24 is pivoted out from the window 17 in direction of arrow 70 (in FIG. 2), becoming inaccessible to the user, below a housing section 18 adjacent to the window 17 (see FIGS. 4 and 5). Together with the actuation member 24, the support axle 23 is pivoted, together with the control roller 21, in the direction of arrow 71, whereby the link block 25 is displaced in the control link 22 to a position in which it is not held any more by the control link 22 in the direction of the dog point 16. As a result, the bolt guide 15 can be removed from the setting tool 10 by being pulled in the direction of arrow 72. In this position, the control link 22 is open in the direction of the dog point 16. In order to pivot the actuation member 24 into the window 17, the bolt guide 15 should be pushed into the setting tool 10 in a direction opposite that shown with arrow 72. With the suitable geometry of the control link 22 having an inclination surface 28, the control roller 21 would be pivoted in a direction opposite that of arrow 71, with the actuation member 24 pivoting in a direction opposite that shown with arrow 70, and into the window 17 (see FIG. 2). The displacement of the drive-in depth setting device 20 from the second position 47 in the first position 46 can now be effected by manually pivoting the actuation member 24.

It should be understood that instead of two switching positions 46, 47, a plurality of switching positions can be provided for displacing the bolt guide 15 in corresponding positions.

Figure 6:
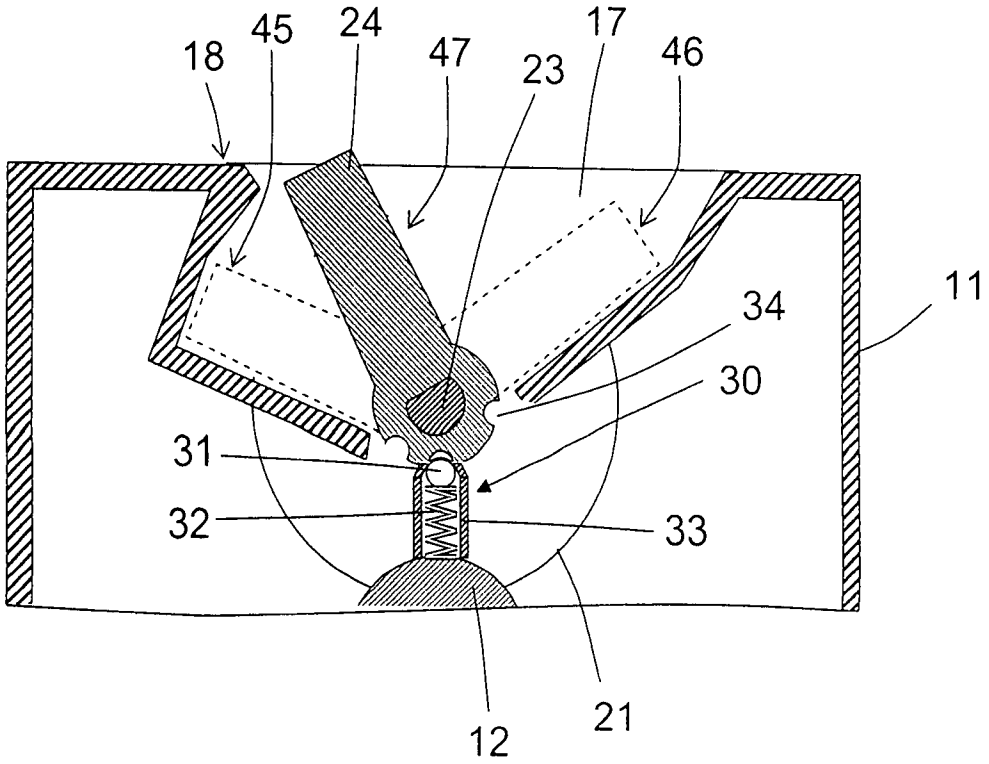
FIG. 6 a cross-sectional view of the inventive setting tool shown in FIG. 2 along line VI-VI in FIG. 2.

For retaining the drive-in depth setting device 20 in the switching positions 45, 46, 47, there is provided a indexing mechanism generally designated with a reference numeral 30 (see FIGS. 3, 5 and 6). The indexing mechanism 30 includes an indexing member 31 formed as a ball and biased by a spring 32. The spring 32 and the indexing member 31 are displaced in a guide cylinder 33. The indexing member 31 cooperates with indexing recesses 34 provided on a circumference of a cylindrical section of the actuation member 24 and a number of which corresponds to the number of switching positions 45, 46, 47. The indexing recesses can be provided at another location, e.g., the indexing recesses can be formed on the control roller or on the support axle.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving a fastening element in a constructional component, comprising:

a housing (11);

a guide (12) located in the housing (11);

a drive member (13) displaceable in the guide (12) and defining an operational axis (A);

a bolt guide (15) for guiding the fastening element (50) and adjoining the drive member guide (12) in a direction of the operational axis (A), the drive member (13) having a drive end (14) located in the bolt guide (15) in an initial position of the drive member (13) for driving the fastening element (50) received in the bolt guide, the bolt guide (15) forming a dog point (16) for abutting the constructional component; and a drive-in depth setting device (20) for displacing the bolt guide (15) axially relative to the drive member guide (12) for setting a distance (D) between the drive end (14) of the drive member (13) and the dog point (16) of the bolt guide (15) in an initial position of the drive member (13), wherein the drive-in depth setting device (20) has a manually operable actuation member (24) that is located in at least two switching positions (46, 47) of the drive-in depth setting device (20), in which the device axially secures the bolt guide (15) in the at least two positions (36, 37) of the bolt guide (15), respectively, in a window (17) formed in the housing (11) where the actuation member (24) is accessible, and in a release switching position (45) of the drive-in depth setting device (20), is covered by a housing section (18) located adjacent to the window (17), wherein the drive-in depth setting device (20) comprises a control link (22) and link block (25) displaceable in the control link (22), which operate between the actuation member (24) and the bolt guide (15), wherein the drive-in depth setting device (20) has a control roller (21) connected with the actuation member (24) for joint rotation therewith, and the control link (22) is provided on the control roller (21), and the link block (25) is provided on the bolt guide (15).

2. A setting tool according to claim 1, further comprising a locking mechanism (30) for releasably retaining the drive-in depth setting device (20) in the at least two switching positions (46, 47).

3. A setting tool according to claim 1, wherein the drive-in depth setting device (20) axially displaces the bolt guide (15) between at least two positions (36, 37), retaining the bolt guide (15) in a respective position.

4. A setting tool according to claim 1, wherein the bolt guide (15) has a release position (35) axially remote from the guide (12) and which corresponds to a release switching position (45) of the drive-in depth setting device (20) and in which the bolt guide (15) is not any more retained by the drive-in depth setting device (20).

5. A setting tool for driving a fastening element in a constructional component, comprising:

a drive member (13) for driving the fastening element (50) and defining an operational axis (A);

a guide (12) for guiding the drive member (13);

a bolt guide (15) for guiding the fastening element (50) and adjoining the drive member guide (12) in a direction of the operational axis (A) and having a dog point (16) for abutting the constructional component, the bolt guide (15) having an initial, fully extended position relative to the drive member guide (12) in which the setting tool cannot be actuated, and a retracted, setting tool actuation-enabling position, the drive member (13) having, in an initial position thereof corresponding to the initial, fully extended position of the bolt guide (15), a drive end (14) thereof located in the bolt guide (15); and a drive-in depth setting device (20) for displacing the bolt guide (15) axially relative to the drive member guide (12) for setting a distance (D) between the drive end (14) of the drive member (13) and the dog point (16) of the bolt guide (15) in the initial position of the drive member (13), wherein the drive-in depth setting device (20) axially displaces the bolt guide between at least two positions (36, 37) of the bolt guide (15) corresponding to at least two switching positions (46, 47) of the drive-in depth setting device, retaining the bolt guide in a respective position thereof, wherein the bolt guide (15) has a release position (35) axially remote from the guide (12) and which corresponds to a release switching position (45) of the drive-in depth setting device (20) and in which the bolt guide (15) is not any more retained by the drive-in depth setting device (20), and wherein the setting tool further comprises an indexing mechanism (30) for releasably retaining the drive-in depth setting device (20) in a respective switching positions (45, 46, 47), wherein the drive-in depth setting device (20) has a manually operable actuation member (24) that is located in the at least two switching positions (46, 47) of the drive-in depth setting device (20), in a window (17) formed in a housing (11) where the actuation member (24) is accessible, and in the release switching position (45) of the drive-in depth setting device (20), is covered by a housing section (18) located adjacent to the window (17).

6. A setting tool according to claim 5, wherein the drive-in depth setting device (20) comprises a control link (22) and link block (25) displaceable in the control link (22), which operates between the actuation member (24) and the bolt guide (15).

7. A setting tool according to claim 6, wherein the drive-in depth setting device (20) has a control roller (21) connected with the actuation member (24) for joint rotation therewith.

8. A setting tool according to claim 7, wherein the control link (22) is provided on the control roller (21), and the link block (25) is provided on the bolt guide (15).

* * * * *